US005947794A

United States Patent [19]

McGrath

[11] Patent Number: 5,947,794

[45] Date of Patent: Sep. 7, 1999

[54] ADAPTER FOR CARRYING AXLED VEHICLES ON MODEL RAILROAD FLAT CARS

[76] Inventor: Joseph D. McGrath, 238 Lincolnshire Dr., Crystal Lake, Ill. 60014

[21] Appl. No.: 09/012,929

[22] Filed: Jan. 24, 1998

[51] Int. Cl.[6] ..... A63H 19/15

[52] U.S. Cl. ..... 446/467; 104/DIG. 1; 105/1.5; 410/19

[58] Field of Search ..... 446/447, 467; 104/DIG. 1; 105/1.5, 15.2; 269/40, 303, 902; 410/9, 10, 19, 22; 211/85.8, 60.1; 248/341.03

[56] References Cited

U.S. PATENT DOCUMENTS

| | | | |
|---|---|---|---|
| 1,261,113 | 4/1918 | Fey | 410/22 |
| 1,326,884 | 12/1919 | Valentine | 410/22 |
| 1,426,164 | 8/1922 | Evans | 410/22 |
| 1,439,663 | 12/1922 | Evans | 410/22 |
| 1,838,975 | 12/1931 | Williams | 410/22 |
| 2,377,904 | 6/1945 | Roach | 269/40 |
| 4,005,945 | 2/1977 | Gutman | 269/902 X |
| 4,861,011 | 8/1989 | Varga | 269/902 X |

FOREIGN PATENT DOCUMENTS

| | | | |
|---|---|---|---|
| 185-355 | 6/1986 | European Pat. Off. | 269/40 |
| 2205825 | 5/1974 | France | 446/447 |

OTHER PUBLICATIONS

Tyco ™ "Flat Car–50 Foot With Piggyback, Sante Fe, 345A" Dec. 1982, with Affidavit.

*Primary Examiner*—D Neal Muir
*Attorney, Agent, or Firm*—Nicholas A. Camasto

[57] ABSTRACT

An adapter for a model railroad flat car enables the carrying of axled model vehicles on model railroad flat cars. The adapter is a thin rectangular block with a transverse groove at each end for engaging the axle, axle housing or axle encasement of a model vehicle being carried on the flat car and facing in either direction. The adapter is secured to the flat car by any suitable means and has minimum visibility when the model vehicle is being carried.

4 Claims, 1 Drawing Sheet

ADAPTER FOR CARRYING AXLED VEHICLES ON MODEL RAILROAD FLAT CARS

BACKGROUND OF THE INVENTION AND PRIOR ART

This invention relates generally to model railroading and specifically to the carrying of model vehicles on model railroad flat cars, in model railroad gondolas, or on any other flat surfaces of model railroad cars (herein, singularly or collectively, referred to simply as "flat car" or "flat cars").

The hobby of model railroading is very popular, with an enthusiast being able to operate equipment having any of a variety of scales, with "O" gauge (1/43"=1"), "S" gauge (1/64"="1") and "HO" gauge (1/87"=1") being some of the more popular ones. In addition to railroad cars, a host of ancillary items, such as stations, factories, houses, bridges, signal towers, crossing gates, vehicles and items of scenery and the like, are available in the same general scales so that very elaborate and true-to-life railroad installations may be assembled and operated. In particular there are a large number of farm vehicles, construction equipment, trucks (including cabs and/or tractor-trailers), cars, circus wagons and the like that are available for use on model railroad layouts.

The present invention is directed to enabling such model vehicles to be transported on model railroad flat cars in a simple, stable and versatile manner. It will be appreciated that with the invention, the vehicles are readily positioned on and removed from the flat cars and remain stable without the need for restraints and the like. Most such vehicles have wheels although some have tractor-type tracks or treads. All have axles and/or axle housings or encasements, and the invention provides for the ready positioning and carrying of such axled vehicles on model flat cars with a high degree of stability and versatility. The terms "axle" and "axled" are used herein to denote all of the above, i.e., vehicles having axles, axle housings or axle encasements.

OBJECTS OF THE INVENTION

A principal object of the invention is to provide a novel adapter for carrying model axled vehicles on model railroad flat cars.

Another object of the invention is to provide a vehicle restraining adapter for model railroad cars that is simple and relatively low in cost.

A further object of the invention is to provide an adapter for model railroad flat cars that enables the carrying of model vehicles with the vehicles facing forwardly or rearwardly.

Still another object of the invention is to provide for the easy loading, unloading and reverse directioning of model vehicles on model railroad cars, even while the model railroad train is being operated.

BRIEF DESCRIPTION OF THE DRAWINGS

These and other objects and advantages of the invention will be apparent upon reading the following description thereof in conjunction with the drawings, in which.

DESCRIPTION OF THE PREFERRED EMBODIMENT

Figure 1:
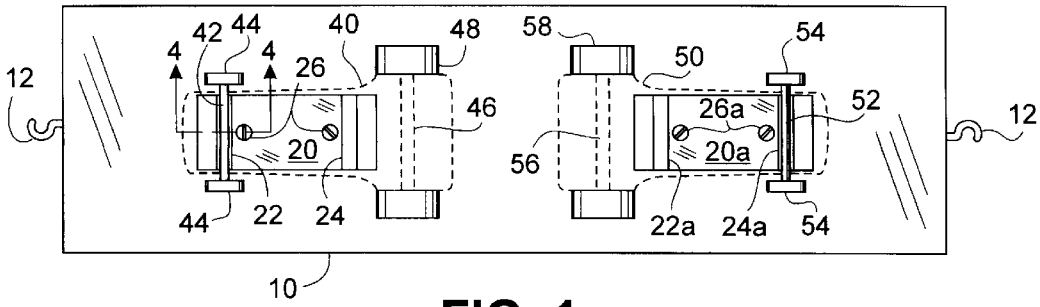
FIG. 1 is a top view of the adapter of the invention in position on a modal railroad flat car.
Figure 2:
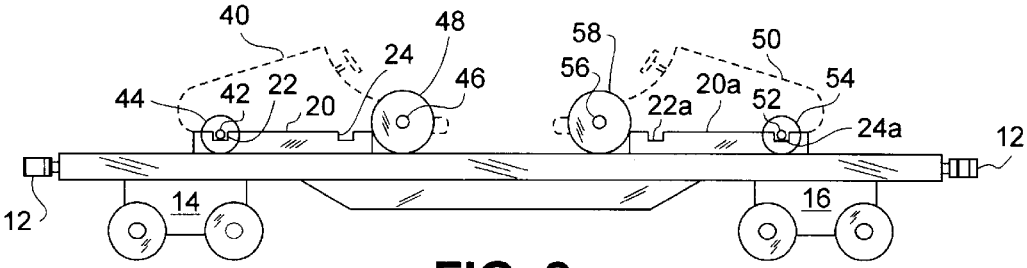
FIG. 2 is a side elevation of FIG. 1.
Figure 3:
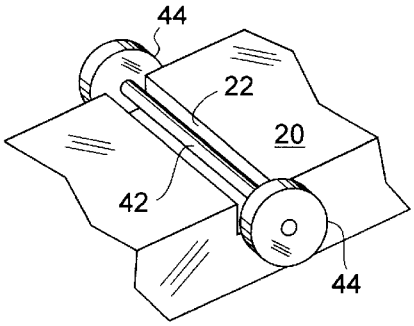
FIG. 3 is a partial perspective view illustrating how the adapter of the invention restrains an axled model vehicle.

FIG. 1 illustrates a plan view of a model railroad flat car 10 carrying a pair of wheeled tractors 40 and 50, illustrated generally by dashed lines. Flat car 10 has front and rear couplings 12 for attaching it to other railroad cars, not illustrated, in a model railroad setting. Two adapters 20 and 20*a* are secured to the top surface or bed of flat car 10 by any suitable means, the one indicated being mounting means 26 and 26*a*. As best shown in FIGS. 2 and 3, each adapter has a pair of slots or grooves formed therein. Thus adapter 20 includes slots 22 and 24 and adapter 20*a* includes slots 22*a* and 24*a*. The slots are transverse to the generally rectangular adapters and are situated near each end. The slots are adapted to provide substantially an interference fit with the axle, axle housing or axle encasement of a model vehicle that is being carried on the flat car. Thus, front axle 42 of vehicle 40 is restrained in slot 22 of adapter 20 and front axle 52 of vehicle 50 is restrained in slot 24*a* of adapter 20*a*. The vehicles indicated have wheels, with vehicle 40 including front wheels 44 rotatably mounted on axle 42 and rear wheels 48 rotatably mounted on rear axle 46. Similarly, front wheels 54 and rear wheels 58 are rotatably mounted on front axle 52 and rear axle 56, respectively, of vehicle 50.

In FIG. 2, the flat car is shown as being supported on a pair of wheel carriages 14 and 16. In railroad parlance, such wheel carriages are referred to as "trucks". The depth of slots 22,24 and 22*a*,24*a* are such that the front wheels of vehicles 40 and 50 either rest on, or are close to, the surface of flat car 10 while their corresponding front axles 42 and 52 are trapped or restrained in slots 22 and 22A, respectively. It will also be noted that the adapters are substantially hidden beneath the model vehicles which adds to the realism of the vehicle carrying arrangement. In the Figures, the model vehicles are shown as facing in opposite directions. This is a matter of choice and the provision of a slot at each end of the adapter enables the model railroader to alternatively position the vehicles to face in the same direction (and in either direction with respect to the direction of travel of the flat car) to suit individual preferences. It will also be appreciated that model vehicles of different types may be carried on the same flat car and that, depending upon their sizes, a greater or lesser number of vehicles may be carried with stability and versatility. Of course, the dimensions of the adapters and the slots will need to be tailored to the different sizes of model vehicles that are to be carried and to the widths of their respective axles, axle housings or axle encasements. Depending on the design and dimensions of the model vehicle, it may be feasible for the vehicle to be carried in one direction only (without reversing the direction of the flat car itself), in which case the adapter may have only a single transverse groove or slot, or only one that may be effectively utilized.

The slots in the adapter provide a multi-point restraint of the axle and therefore contribute to the stability of the model vehicle while being carried. It will be noted that the unrestrained wheels or treads rest solidly on the surface of the flat car which provides an even greater degree of stability, particularly if the wheels are constructed of rubber, soft plastic or other flexible material. A single point restraint would not be nearly as stable and could result in shifting of the model vehicle during transit, for example while passing over switches or rough sections of track, or during turns. It will also be noted that the majority of such model vehicles are constructed of die cast metal. Consequently, the vehicles have significant weight, which adds to the friction force between the unrestrained wheels or treads and the flat car surface. The adapters may obviously be fabricated in a number of ways, such as by molding, and may comprise different types of materials. In the preferred embodiment, the adapters are made of plastic and painted to match the color of the flat car.

Figure 4:
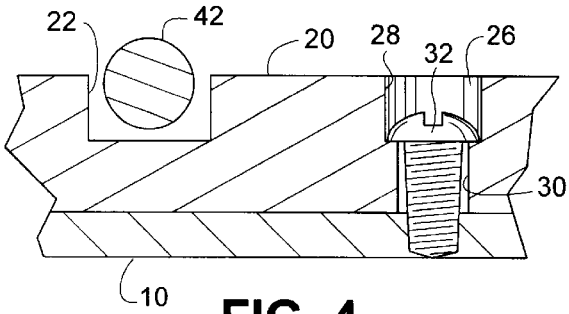
FIG. 4 is a partial section taken along line 4—4 of FIG. 1.

The arrangement used to secure the adapters to the flat car may also take any number of forms. In some installations, a permanent mounting of the adapters to a flat car may be preferred and the adapter may be secured to the flat car by glue, rivets, pins or the like. In arrangements where flexibility is desired in the types of model vehicle carried, the adapters may be screwed to the flat car as shown in FIG. 4, mounted by magnetic means, held by removable pins or by hook and loop fasteners, as will be discussed in connection with FIG. 6. All such techniques are believed to be within the skill of those practicing in the art and the invention is not to be limited to any particular type of fastening.

The FIG. 4 illustration shows the desired relationship between axle 42 and slot 22 in which the axle is relatively loosely restrained within the slot. Such an arrangement serves the function of adequately restraining the model vehicle while permitting tolerances in the slot dimensions for accommodating a range of different model vehicles with the same size adapter. Mounting means 26 comprises a screw 32 that secures adapter 20 to flat car 10 via a through hole 30 and a countersunk hole 28.

Figure 5:
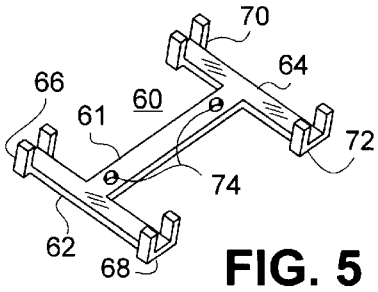
FIG. 5 is a perspective view illustrating another version of the adapter of the invention.

The arrangement of FIG. 5 illustrates an alternative construction for an adapter 60 that is especially suitable for molding. The adapter is generally H-shaped with a center member 61 and two transverse cross members 62 and 64. At the extremities of the cross members are four U-shaped restraining members 66, 68, 70 and 72, which function to provide a multi-point restraint of the axle of the model vehicle in much the same manner as the slots of the previously described adapters. This version of the adapter may be conveniently mounted to the flat car by means of a pair of holes 74.

Figure 6:
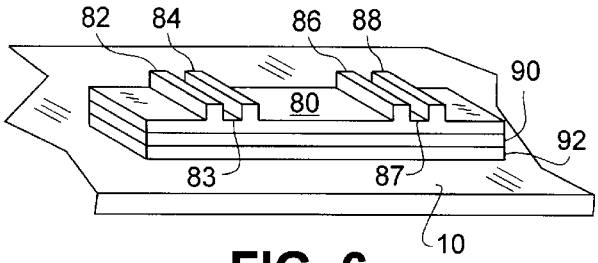
FIG. 6 is a perspective view of still another version of the adapter of the invention and of a different technique for attaching the adapter to a model railroad flat car.

FIG. 6 illustrates yet another configuration for an adapter 80 of the invention. In this arrangement, a pair of slots 83 and 87 are formed between upstanding wall portions 82,84 and 86,88, respectively, of adapter 80. Additionally, the adapter is illustrated as being secured to flat car 10 by a combination of a first layer 90 and a second layer 92. In one version, first layer 90 and second layer 92 may have their outer surfaces glued to the underside of adapter 80 and to the surface of flat car 10, respectively. The first and second layers 90 and 92 may take the form of a hook and eye attachment with, for example, layer 90 comprising a hook structure and layer 92 comprising a loop structure. The layers may also comprise pieces of magnetic material, in which event the holding force will be magnetic. The advantage of these layer attachment means resides in the removability of the adapter. Should the flat car be constructed of a magnetically permeable material, the layer 92 need not even be glued or otherwise secured to the flat car surface, since the magnetic force will suffice.

The model vehicles may also be attached to the flat car by a series of fixed or removable holding pins that are inserted vertically through the adapter and into pre-drilled or molded holes, or similar receptacles that are positioned in the surface of the flat car. Also, molded protrusions that extend from the bottom of the adapter may be inserted into pre-drilled or formed holes or similar receptacles that are appropriately positioned in the surface of the flat car. None of the above-mentioned fastening systems is considered to be limiting of the invention.

What has been described is a novel adapter for enabling axled model vehicles to be carried securely on the bed of a model railroad flat car. It is recognized that numerous changes in the described embodiment of the invention will occur to those skilled in the art without departing from its true spirit and scope. The invention is to be limited only as defined in the claims.

What is claimed is:

1. An adapter supporting a model wheeled vehicle on a model railroad flat car comprising:

an undercarriage restraint positioned on said flat car and located beneath said model wheeled vehicle, said undercarriage restraint having a low profile, said restraint being an assentially rectangular thin, block, being substantially shorter than said wheeled vehicle and narrower than the width of said wheeled vehicle for achieving minimal visibility of the undercarriage restraint and total visibility of the wheeled vehicle;

means in said undercarriage restraint for engaging an axle of said model wheeled vehicle being carried on said flat car; and means for securing said undercarriage restraint to said flat car.

2. The adapter of claim 1, wherein said undercarriage restraint comprises said thin rectangular block, including a transverse, axle-engaging, generally U-shaped groove, positioned on said flat car beneath said model wheeled vehicle.

3. The adapter of claim 2, further including:

a second generally U-shaped transverse axle-engaging groove in said block, said transverse grooves being situated at opposite ends of said block whereby said model vehicle may be carried on said flat car while facing in either direction.

4. The adapter of claim 3, further comprising:

a plurality of said restraints on said flat car for carrying a like plurality of said model vehicles.

* * * * *